US005423711A

United States Patent [19]

Dorland

[11] Patent Number: 5,423,711

[45] Date of Patent: Jun. 13, 1995

[54] CONVERTIBLE BODY GARMENT WITH ODOR ABSORBING PROPERTIES AND PROCESS OF USE THEREOF

[76] Inventor: Gabrielle J. Dorland, 18 Glenbrook Dr., Mendham, N.J. 07945

[21] Appl. No.: 34,795

[22] Filed: Feb. 11, 1993

[51] Int. Cl.[6] ..... A41C 3/00

[52] U.S. Cl. ..... 450/57; 450/1; 450/37; 450/80; 450/82; 2/73; 2/267

[58] Field of Search ..... 2/55, 56, 58, 53, 54, 2/69, 69.5, 67, 104, 105, 106, 109, 110, 114, 310, 311, 312, 338, 247, 248, 249, 250, 251, 252, 253, 254, 400, 401, 402, 403, 404, 405, 406, 407, 408, 409; 450/30, 31, 32, 36, 37, 54, 55, 56, 57, 58, 61, 80, 82, 83, 84, 86, 88, 89, 102, 103, 104, 105; 5/485, 655, 93.1, 492, 493, 462, 463; 297/188, 190, 191, 219.2, 228.12, 250.1, 274; 602/19; 607/108, 112

[56] References Cited

U.S. PATENT DOCUMENTS

| | | | |
|---|---|---|---|
| 1,136,727 | 4/1915 | Smith | 450/37 X |
| 1,189,589 | 7/1916 | Lawrence | 450/37 |
| 1,391,936 | 9/1921 | Bosky | 450/89 X |
| 2,023,612 | 12/1935 | Park et al. | 450/88 |
| 2,302,844 | 11/1942 | Ebbott | 2/88 |
| 4,142,264 | 3/1979 | Whiting | 5/334 R |
| 4,412,542 | 11/1983 | Reichert | 450/30 X |
| 4,545,080 | 10/1985 | Gorham | 2/54 |
| 4,742,827 | 5/1988 | Lipton | 607/112 X |
| 4,824,168 | 4/1989 | Makoski | 297/191 |
| 4,854,915 | 8/1989 | Luedy | 450/31 |
| 4,960,112 | 10/1990 | Anderegg | 450/37 OR |
| 4,989,285 | 2/1991 | Troncone et al. | 5/482 |
| 5,014,376 | 5/1991 | Doran et al. | 5/431 |
| 5,042,090 | 8/1991 | Cook | 2/69 |
| 5,274,852 | 1/1994 | Hogan | 2/69 X |

FOREIGN PATENT DOCUMENTS 1276791 10/1961 France .

OTHER PUBLICATIONS

Gershman, Maurice, "Self Adhering Nylon Tapes." The J.A.M.A, vol. 168, No. 7, p. 930, Oct. 1958.

*Primary Examiner*—Jeanette E. Chapman
*Attorney, Agent, or Firm*—Antonelli, Terry, Stout & Kraus

[57] ABSTRACT

A process for promoting bonding between a person such as a working mother and an infant or young child is disclosed. A garment is worn in contact with the skin of the person to whom bonding is to be promoted, such as in contact with a person's torso. The garment is comprised of a material which absorbs odor from the body. A fastening mechanism (24) attaches the garment to the body for a time sufficient to retain the odor. The worn garment is attached to a garment support (50) with the fastening mechanism sufficiently close to the infant so that the infant may smell the retained odor for a time sufficient to promote bonding.

8 Claims, 5 Drawing Sheets

CONVERTIBLE BODY GARMENT WITH ODOR ABSORBING PROPERTIES AND PROCESS OF USE THEREOF

TECHNICAL FIELD

The present invention relates to garments and a process of use of garments which are worn by a person to absorb a high concentration of that person's unique personal body odor which is used to promote bonding between the person and an infant or another person by olfactive identification of the absorbed personal body odor.

BACKGROUND ART

Every person possesses a unique body odor which is continuously emitted in perspiration and skin secretions. Several areas of the body emit a higher concentration of body odor, such as the breasts of a lactating mother, the axillary or the groin as a result of the concentration of skin glands therein. Studies further indicate that infants recognize and favorably respond to the body odor of their mother by preferentially orienting towards odors from the breast or axillary region of their own mother in comparison with comparable odors from other lactating or non-lactating mothers. An infant's recognition of the familiar body odor of its mother may promote feelings of comfort and security, and facilitate breast feeding by orienting the infant's face towards the mother's breast and nipple. It is known that children sleep more soundly when holding a handkerchief scented with the mother's axillary odor.

Studies indicate that breast fed infants who are in close proximity to their mother's bare skin and axillary region for extended periods of time are more sensitive to their mother's unique body odor than bottle-fed infants who experience less skin to skin contact and, therefore, less exposure to their mother's body odor. Infants may be conditioned to respond favorably to specific scents other than their own mother's body odor by familiarization with direct exposure to the odor.

Chapter 24 of "Human Reproduction and the Mother-Infant Relationship" entitled "The Role of Odors" (appearing in *Smell and Taste in Health and Disease*, pp. 429–442) reports that a nursing baby after the passage of time learns to recognize their mother's scent on pads that have been worn against their mother's breast when positioned along the side of the baby's face such as by being suspended so as to be in proximity to the baby's face. Further, Chapter 24 reports studies that children can recognize the scent of their mother which has been captured by a worn T-shirt.

Further, Volume 13(2) of *Chemical Senses*, pages 145–190, entitled "Olfaction in Infants and Children: Developmental and Functional Perspectives" by Benoist Schaal, discusses a study with handkerchiefs worn near the axillae for 48 hours for the purpose of inducing sleep. However, the study did not report definitively if the odor of the handkerchief was responsible for improved sleeping.

While the prior art recognizes that the characteristic odor of a mother as absorbed by a pad worn directly on the body or on a T-shirt may stimulate the olfactory response of that mother's children, there is nothing in the prior art which recognizes that scent-impregnated clothing or pads may be used to promote bonding between an infant and persons such as a mother. Furthermore, there are no garments in the prior art which are designed to be comfortably worn by a person, such as a nursing mother, with or without odor absorbent pads attached to an inner side of the garment and that are attached to a garment support in proximity to an infant or young child for stimulating the olfactory senses of the infant or child to promote bonding.

The prevalent practice of mothers going back to work almost immediately after delivery of their babies interferes with the mother and baby having sufficient close skin contact right after delivery which permits the baby to learn of the mother's scent as part of the bonding process.

The literature is replete with studies regarding the olfactory senses of infants or young children. The following is a summary of the literature regarding olfactory sensing by infants or young children.

Macfarlane, A. (1975), "Olfaction in the development of social preferences in the human neonate." In Ciba Foundation Symposium, The human neonate in parent-infant interaction, Amsterdam: Associated Scientific Publishers.

Russell, Michael J., "Human Olfactory Communication," *Nature*, pp. 520–522, vol. 260, 8 April 1976.

Russell, Michael J., Terrie Mendelson and Harman V. S. Peek, "Mothers' Identification of Their Infant's Odors," *Ethology and Sociobiology*, pp 29–31, vol. 4, 1983.

Porter, R. H., Cernoch, J. M. & McLaughlin, F. J. (1983), "Maternal recognition of neonates through olfactory cues", *Physiology & Behavior*, vol. 30, pp. 151–154. Cyrulnik 1982.

Cyrulnik, 1982 Personal communication to Benoist Schaal, "Olfaction in infants and children: developmental and functional perspectives," *Chemical Senses*, vol. 13, no. 2, pp. 145–190, 1988.

Russell, Michael J., Terrie Mendelson and Harman V. S. Peeke, "Mothers' Identification of Their Infant's Odors," Ethology and Sociobiology, pp 29–31, vol. 4, 1983.

Cernoch, Jennifer M. and Richard Porter, "Recognition and Maternal Axillary Odors by Infants," *Child Development*, pp. 1593–1598, vol. 56, 1985.

Gallois, C., 1985 "Etude preliminaire du role des facteurs visuels, olfactifs et somestheques dans l'attractivite de l'ours en peluche pour le jeune enfant," Unpublished DEA report University of, Bersabson.

Balogh, Rene D. and Richard Porter, "Olfactory Preferences Resulting from Mere Exposure in Human Neonates" *Infant Behavior and Development*, pp. 395–401, vol. 9, 1986.

Porter, Richard H., Rene D. Balogh, Jennifer M. Cernoch and Christie Franchi, "Recognition of Kin Through Characteristic Body Odors," *Chemical Senses*, pp. 389–395., vol. 11(3), 1986.

Schaal, Benoist, "Olfaction in Infants and Children: Developmental and Functional Perspectives," *Chemical Senses*, pp. 145–190, vol. 13(2), 1988.

Lord, Thomas and Mary Kasprazak, "identification of Self Through Olfaction," *Perceptual and Motor Skills*, pp. 219–224, vol. 69, 1989.

Schleidt, Margret and Carola Genzel, "The Significance of Mother's Perfume for Infants in the First Weeks of Their Life," *Ethology and Sociobiology*, pp 145–154, vol. 11, 1990.

Schmidt, Hilary J. and Gary K. Beauchamp, "Adult-Like Odor Preferences and Aversions in Three- Year-Old Children", *Child Development*, pp 1136–1143, vol. 59, 1988.

Sullivan, Regina M., Suzanne Taborsky-Barba, Raffael Mendoza, Alison Itano, Michael Leon, Cal W. Cotman, Terrence F. Payne and Ira Lott, "Olfactory Classical Conditioning in Neonates," *Pediatrics*, pp 511–518, vol. 87(4), April, 1991.

DISCLOSURE OF INVENTION

The invention provides a process and an article of clothing used for enhancing the bonding between persons and infants or young children which utilizes a person's unique skin emissions and perspiration that define a unique body odor. The unique body odor is absorbed by either the fabric from which a garment is made or a removable body odor absorbing material, such as a pad, which is attached to or contained within pockets on the inside surface of the garment. The garment is wrapped around the person's body, such as the torso and under the arms, so as to contact the breast and axillary areas of the body to absorb body odor in the garment and/or pads. Thereafter, the worn garment or a removable body odor absorbing material is attached to a garment support with a fastening mechanism while retaining the odor sufficiently close to the infant or young child so that the characteristic odor is smelled for a sufficiently long time interval, which is preferably at least a period of several days to weeks, to promote bonding or the worn body odor absorbing material is attached to a material support while retaining the odor for the aforesaid time interval sufficiently close to the infant so that the infant may smell the odor to promote bonding. During the bonding period, the garment or body odor absorbing material may be repeatedly worn by the person so that the concentration of the person's odor is refreshed and maintained at a high level to maximize the olfactory stimulus produced by the absorbed odor.

The garment may be convertible to a flat covering which can be fastened around a sleeping/resting surface for the infant such as a mattress, car seat, infant swing, or infant carrier which is positioned in close proximity to the nose of the infant so that the odor absorbed by the garment or removable odor absorbing material can be inhaled by the infant or young child in proximity thereto. The providing of the infant or young child with the familiar body scent of a person to whom bonding is to be promoted is predicated upon the retention of the person's unique body odor by the garment or body odor absorbing material during the bonding period. The frequency of "refreshing" the person's odor during the bonding period of days or weeks in proximity to the infant or young child dictates the number of times the person will rewear the garment with or without odor absorbing pads. Typically, the garment would be worn on a daily basis for the purpose of "refreshing" the person's odor during the bonding period.

The invention provides the following benefits. For infants and children separated from their mothers or fathers, the mother or father/infant olfactive bond may be maintained through surrounding the infant or child with the mother's or father's unique and familiar body odor by use of a garment which has been worn by her or him or by body odor absorbing materials which will soothe the infant or child and help promote feelings of security and comfort. Bottle fed infants, who may not be able to develop a strong olfactive bond with their mother due to a reduced bare skin contact compared to breast fed infants, will be able to learn of their mother's unique body odor and thus will develop and maintain an olfactive bond between the infant and mother. Furthermore, the invention may be used by a caretaker other than the infant's mother in order to familiarize the infant with the mother's unique body odor while she is not physically present during providing of care. Furthermore, the invention may be used by persons other than the mother/caretaker in infant/child care. For example, two adults separated from each other as a result of travel or a hospital stay may use the invention to promote feelings of security and comfort by surrounding one person with the familiar soothing body odor of the other person.

The invention is preferably practiced with a garment which is worn by the person in contact with the torso to promote odor absorbance from the axillae and/or breasts. However, other areas of the body having a high concentration of skin glands, such as the groin, may also be used to absorb odor from a garment either with or without odor absorbing pads.

In a preferred application of the invention, the use of body odor absorbing materials attached to the inner surface of the garment enhances the absorbance of odor. The body odor absorbing materials may be made from moisture absorbing materials, such as natural fabrics like cotton, or man-made fabrics which readily absorb moisture such as those used in sanitary napkins. A preferred source of the body odor absorbing materials are commercially available sanitary napkins both from a standpoint of ready availability at low cost and from a standpoint of having adhesives which are used to attach the body odor absorbing material to a support by removing a protective cover.

A process for promoting bonding between a person and an infant in accordance with the invention includes wearing a garment in contact with at least the person's body, such as the torso, comprising a material which absorbs odor from the body and a fastening means for attaching the garment to the body for a time sufficient to retain the odor; and attaching the worn garment to a garment support with the fastening means sufficiently close to the infant so that the infant may smell the retained odor for a time sufficient to promote bonding. The garment may also be worn in contact with the person's axillae so as to absorb odor from the axillae with the garment attached to the garment support retaining the odor absorbed from the axillae. The garment support may be a mattress, a car seat, an infant swing or an infant carrier, etc. During the bonding period, the odor absorbed by the garment or body odor absorbing material may be refreshed by rewearing the garment with or without the same or new body odor absorbing material. The bonding period may be from a week to a month or more in duration with refreshing of the odor on the garment and/or body odor absorbing material during the initial bonding period. Thereafter the person's odor may be refreshed on the garment and/or the body odor absorbing material to maintain bonding and to promote calmness in the absence of the person from the infant.

The garment may be elongated and further comprise removable straps with the straps each being attached at two spaced apart positions along an elongated side with arms of the person extending through loops defined by the attached straps and the elongated sides during wearing of the garment. The garment may further comprise at least one pocket on an inside surface of the garment which has an open mesh or weave which contains a removable body odor absorbing material within the pocket which, as a consequence of the open mesh or weave, directly contacts the person's skin and which has a greater odor absorbing capability than other parts of the garment with the removable body odor absorbing material absorbing the person's odor during wearing and retaining the absorbed odor during attachment of the body odor absorbing material to the garment support.

The fastening means may be of differing designs. At least one hook and loop pile fasteners (VELCRO) fastener may be attached at opposed ends of the garment with the fastener attaching the garment to the body, such as the torso, during absorbing of the person's odor and to the garment support during bonding of the infant or young child to the person's odor. Alternatively, at least one tie may be attached at opposed ends of the garment with the tie attaching the garment to the body during absorbing of the person's odor and to the garment support during bonding of the infant or young child to the person's odor.

The garment may comprise at least one pair of pockets disposed on an inside surface of the garment having the aforementioned open mesh or weave. The pockets may contain the removable, odor absorbing material which absorbs odor to a greater degree than a remainder of the garment with the pockets being positioned to be worn in contact with a woman's breasts and/or axillae.

A process for promoting bonding between a person and an infant in accordance with the invention includes wearing a garment in contact with at least a person's body, such as the torso, comprising at least one removable body odor absorbing material which is detachable from an inner surface of the garment which absorbs odor from the body for a time sufficient to retain the odor; and attaching the at least one worn body odor absorbing material to a material support while retaining the odor disposed sufficiently close to the infant so that the infant may smell the retained odor for a time sufficient to promote bonding. The garment comprises at least one pocket disposed on an inside surface of the garment having an open weave or mesh for containing the at least one removable body odor absorbing material during wearing of the garment to absorb the body odor by contact of the body odor absorbing material directly with skin of the person; and the at least one removable body odor absorbing material has an adhesive portion which is covered with a removable strip which is removed after removal from the at least one pocket for attachment to the support by the adhesive portion. The support is a material section attached to a crib containing the infant. Alternatively, the support is a material section having at least one pocket for receiving and retaining the at least one removable body odor absorbing material; and the at least one pocket of the support retains the at least one removable body odor absorbing material after absorbing the odor of the person wearing the garment and the material section is attached to a crib containing the infant. The at least one removable body odor absorbing material is worn in proximity to at least one breast so as to absorb odor therefrom.

BEST MODE FOR CARRYING OUT THE INVENTION

Figure 1:
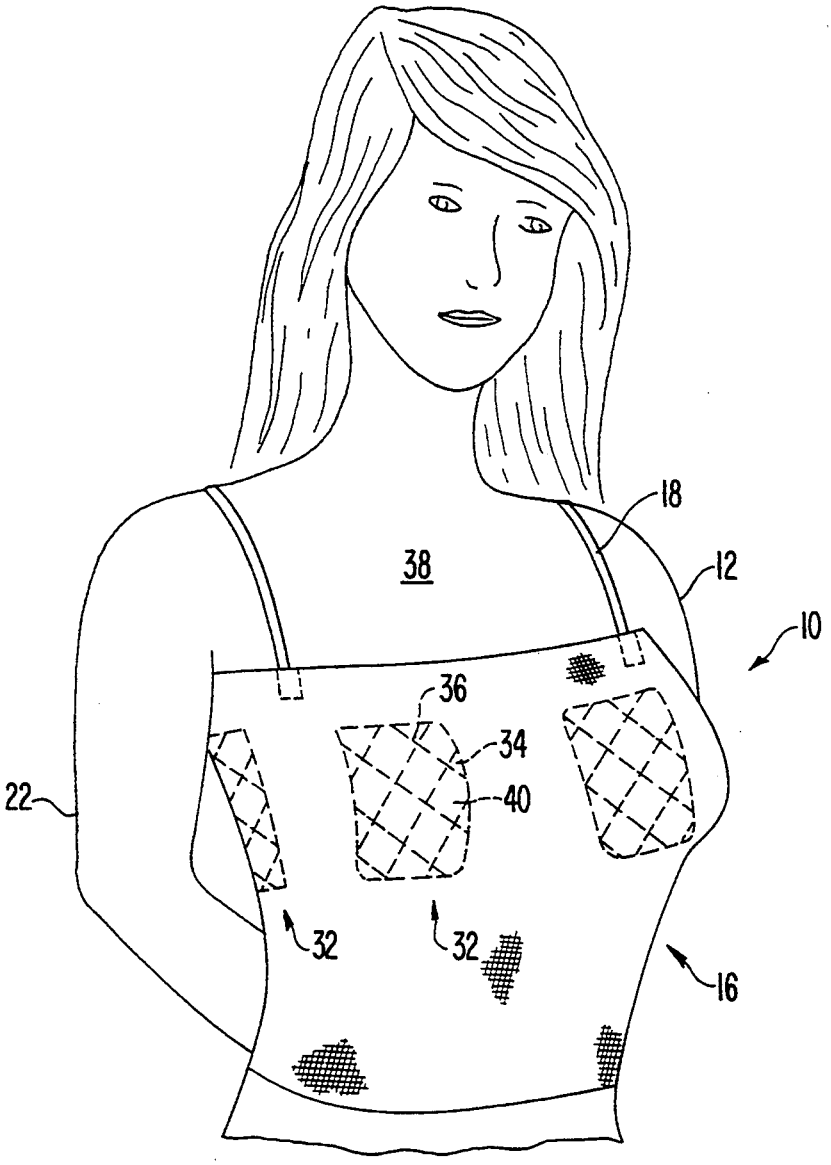
FIG. 1 illustrates the wearing of a garment in contact with a person for the purpose of absorbing odor used in the process for promoting bonding between a person and an infant or young child in accordance with the present invention.

FIGS. 1–4 illustrate a first embodiment of a process for promoting bonding between a person and an infant or young child in accordance with the invention. A multiple purpose garment 10 is utilized for the practice of the invention which is worn by a person 12 such as, but not limited to, a nursing mother, for the purpose of absorbing that person's unique body odor to promote bonding based upon the infant or young child 14 recognizing through olfactory sensing the person's unique body odor which has been absorbed by the garment. The garment 10 is preferably worn around the torso of the wearer 12 but it should be understood that the present invention is not limited to wearing of the garment in contact with the torso to absorb the person's unique body odor to promote bonding. Other areas of the body which have a high concentration of glands, such as the groin, may be contacted with a garment designed to fit those areas for the purpose of absorbing odor either in the fabric from which the garment is made or from body odor absorbing materials as described below. As illustrated in FIGS. 1–4, the garment is formed from a rectangular piece of fabric 16 which may be made from naturally occurring materials or blends thereof, such as cotton and/or blends with man made materials which absorb perspiration or body secretions. A pair of removable straps 18 are attached to the elongated side 20 of the rectangular shaped garment. The removable straps 18 are attached at two spaced apart positions along the elongated side 20 with the arms extending through loops defined by the attached straps and the elongated side during wearing of the garment 10.

Figure 2:
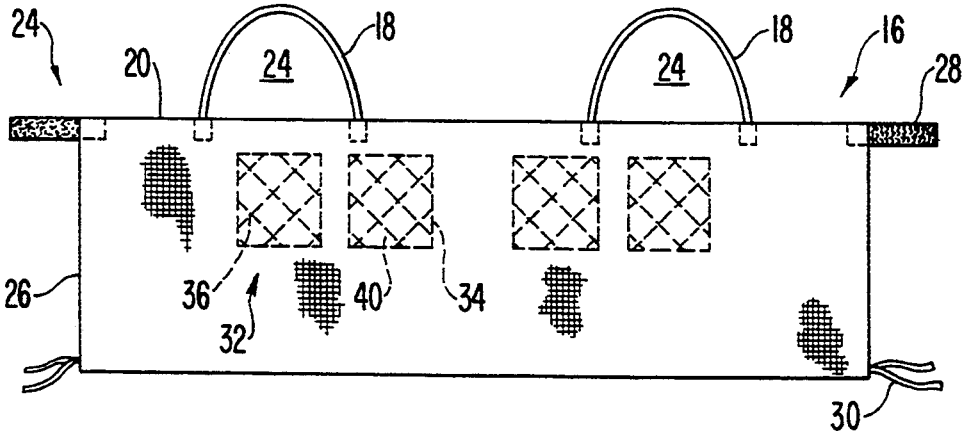
FIG. 2 illustrates a plan view of the garment of FIG. 1.

A multiple purpose attachment mechanism 24 is attached to corners of the shorter side 26 of the rectangular shaped material 16. The attachment mechanism 24 may be in the form of hook and loop pile fasteners (VELCRO) attachments 28, such as those illustrated in the top left and right-hand corners of FIG. 2, string ties 30, such as those illustrated in the bottom left and right-hand corners of FIG. 2, or hook and eyelet attachments, buttons and holes or other known clothing attachment mechanisms to permit the garment to be closed around the front side or back of the person 12. As illustrated in FIGS. 1 and 2, the garment 10 is attached to the backside of the woman 12 but it should be understood that the place of attachment in the back is only one of the possible choices. Furthermore, while FIG. 2 illustrates a combination of hook and loop pile fasteners (VELCRO) and string attachments 28 and 30, attached to the left and right-hand corners of the rectangular garment 16, it should be understood that generally only one type of attachment mechanism will be attached to the left and right, top and bottom corners of the garment.

At least one and preferably a plurality of pairs of pockets 32 are attached to the inner surface of the garment 10 in proximity to areas of the skin which have a high concentration of glands, such as the breasts or axillae. As illustrated, two pairs of pockets 32 respectively are attached to the inner surface of the garment 16 to contact the breasts and axillae of the woman 12. The outline of the pockets 32 is illustrated by the phantom lines 34. Preferably, the pockets are defined by a loose weave or mesh which is designed to retain a body odor absorbing material as described below in conjunction with FIG. 7. The loose weave or mesh, which is symbolized by intersecting dotted lines 36, permits substantial direct skin contact between the material through openings 40 from which the body odor absorbing material or pad is manufactured and the skin 38 of the person wearing the garment 10. The absorbance of the person's unique body odor is enhanced by the open weave which permits direct bare skin contact with the body odor absorbing material which has the ability to absorb more odor than the surrounding material from which the garment is manufactured. It should be understood that any lightweight material having an open weave which enhances body secretions being directly absorbed by the body odor absorbing material of FIG. 7 through the pocket 32 promotes the absorbance of odor. A substantially open weave or a crossed series of threads defining the openings 40 promotes the aforementioned bare skin contact with the body odor absorbing material.

While FIGS. 1 and 2 illustrate the garment in its simplest form without any aesthetic enhancements as to its attractiveness, it should be understood that the garment may be configured in the form of a nightgown or a nightshirt which promotes comfort for the wearer while performing its overall purpose of providing a mechanism for absorbing body odor to promote the bonding process.

Figure 3:
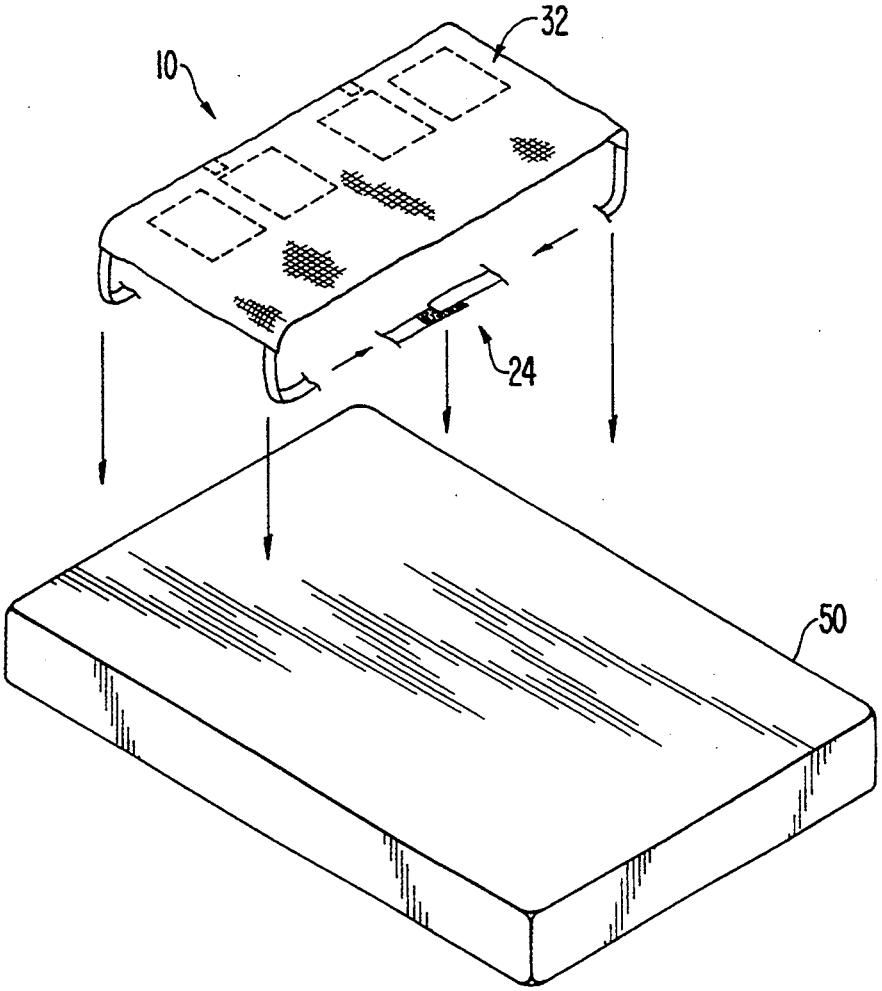
FIGS. 3 and 4 illustrate the attachment of the worn garment of FIGS. 1 and 2 to a garment support which is an infant bed, such as that found in a crib, while retaining the odor sufficiently close to an infant so that the infant may smell the odor to promote bonding.
Figure 4:
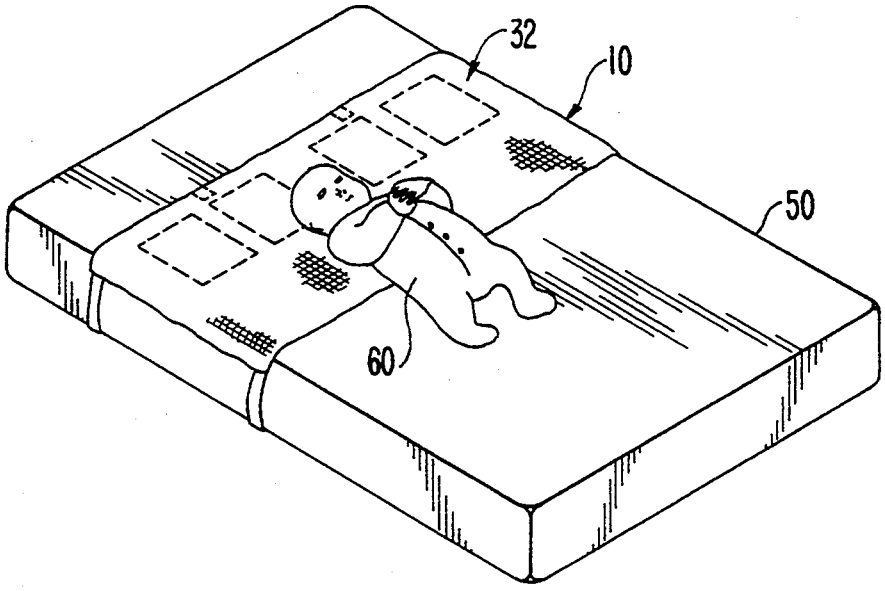

FIGS. 3 and 4 illustrate the attachment of the garment 10 to a child's mattress 50 such as that commonly found in a crib. As illustrated, the attachment mechanism 24 of the garment 10 performs the dual purpose of attaching the garment to the wearer (not visible in FIG. 1 as a consequence of closure on the backside of the person) and further attachment to the mattress 50. Furthermore, the pockets 32 may retain the body odor absorbing material as discussed below in FIG. 7.

As illustrated in FIG. 4, after the garment 10 is attached to the mattress 50, the infant 60 is placed on the mattress such that his or her nose will be in close proximity to the worn garment 10 which retains the odor absorbed from the wearer as a consequence of wearing the garment as illustrated in FIG. 1. With the attachment of the garment 10 to a mattress 50, positioning of the infant's nose right next to areas of high concentration of absorbed odor is ensured because of the head being placed on the garment which is attached to the mattress by the fastening mechanism 24. As is illustrated in FIGS. 3 and 4, the removable straps 18 are preferably removed. The body odor absorbent material, as described below, may be positioned in the pockets 32 during wearing of the garment 10 as illustrated in FIG. 1 and retained in the pockets 32 when the garment is attached to the mattress 50 as illustrated in FIG. 4.

The preferred practice of promoting bonding between a person and an infant or young child 60 in accordance with the invention utilizes the refreshing of absorbed odor periodically while attaching the worn garment 10 with or without body odor absorbing materials as described below in conjunction with FIG. 7 to a garment support during the bonding process between the infant or young child and the person so that the unique characteristic odor of the person wearing the garment may be smelled for a prolonged period of time such as days, weeks or months while being periodically refreshed by rewearing of the garment on a daily basis. Preferably, the garment is worn for a period of at least several hours to promote the absorbance of body odor from the axillae and/or breasts. While the garment 10 may be worn during the day, a typical wearing pattern would involve its wearing during the night, especially for use by a woman 12 who will not be caring for her infant during the day. In this circumstance, the garment 10 may be worn overnight and placed around the garment support such as the mattress 50 during the day while the mother 12 is not available to provide care. Alternatively, the garment 10 could be worn for a period of one or more days to become highly saturated with the wearer's unique body odor and thereafter attached to the garment support for a period of several days. The aforementioned process may be performed periodically wherein the wearer 12 wears the garment for one or more days followed by attachment to the garment support, as described above in conjunction with FIGS. 3 and 4 and in conjunction with FIGS. 8–13 below for one or more days followed by wearing of the garment for one or more days, etc. Furthermore, the garment 10 may be laundered after it becomes substantially soiled. Finally, the use of body odor absorbing materials permits the discarding of these materials after they become soiled or unsanitary at low cost to the user.

Figure 5:
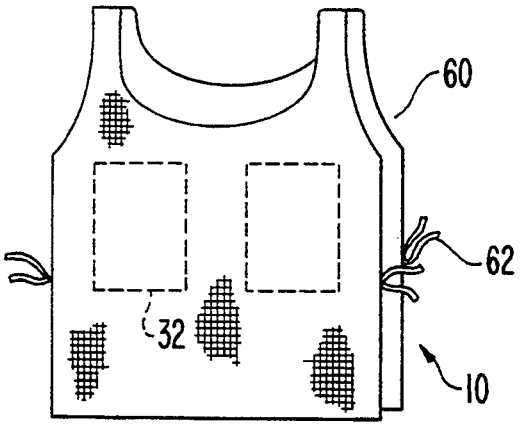
FIG. 5 illustrates an alternative form of the garment of FIG. 1.
Figure 6:
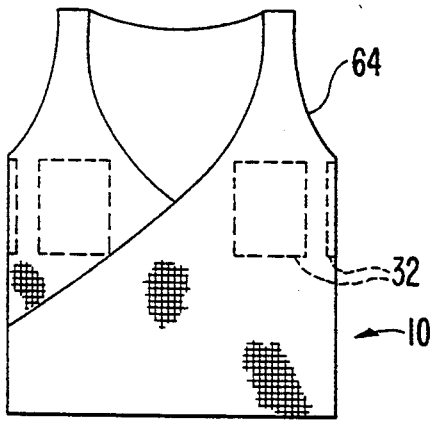
FIG. 6 illustrates an alternative form of the garment of FIG. 1.

FIGS. 5 and 6 illustrate alternative forms of the garment 10. As illustrated in FIG. 5, the garment may be in the form of a tank top 60 having a plurality of pairs of ties 62 which permit the garment may be sized to fit wearer's of different body size. As illustrated, the pockets 32 for retaining the body odor absorbing materials, as described below in FIG. 7, are provided. FIG. 6 illustrates a second alternative form of the garment 10 in the form of a wrap-around tunic 64. Fasteners for holding the tunic 64 in place have been omitted, but it should be understood that any conventional fastening mechanism for the tunic may be utilized. Two pairs of pockets 32 for retaining body odor absorbing materials are provided in the tunic 64.

Figure 7:
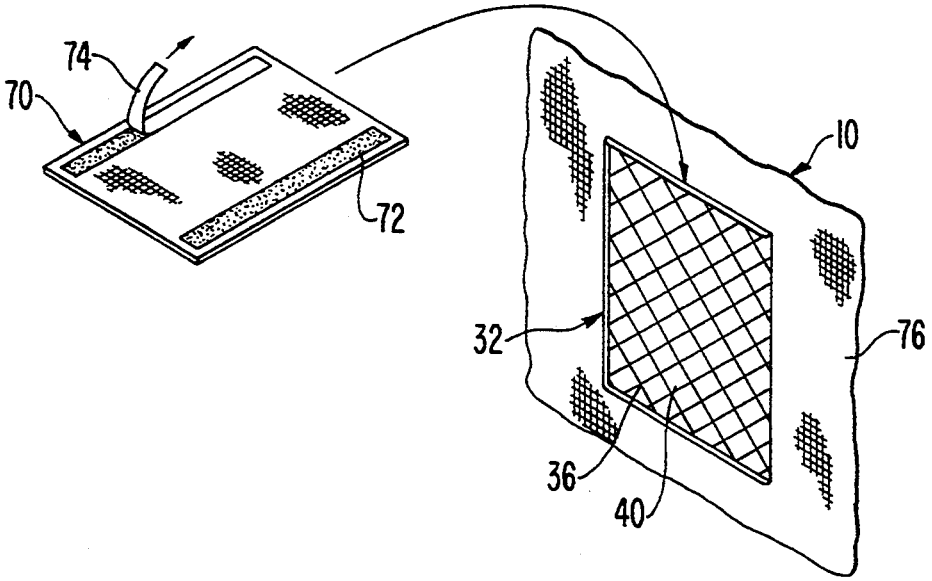
FIG. 7 illustrates a body odor absorbing material of the type having adhesive strips which is positioned in a pocket located on the inner side of the garment for purposes of direct skin contact between the body odor absorbing material and the person wearing the garment.

FIG. 7 illustrates the use of body odor absorbing materials 70 in accordance with the present invention for the purpose of enhancing the absorbance of the unique body odor of the wearer of the garment 10. The advantages of using the body odor absorbing material 70 are threefold. First, body odor absorbing materials 70 promote the overall absorption process both in providing a greater degree of absorption of the wearer's unique body odor and further speeding up the rate at which the body odor is absorbed. The body odor absorbing materials 70 may be in the form of a sanitary napkin of the type conventionally sold in drugstores having self-adhesives 72 covered by removable cover strips 74 such as those which are intended for attachment to underwear. The use of sanitary pads as body odor absorbing materials provides a ready source of supply in drugstores, etc., permits disposability and provides a mechanism for readily attaching the body odor absorbing materials to a garment support if they are removed from the garment 10 such as that described below in FIGS. 8–10. The inside surface 76 of the garment has a pocket 32, as described above in FIGS. 1, 5 and 6, which is preferably defined by the open weave or mesh described above in conjunction with FIG. 1. The openings 40 permit direct contact between the skin 38 of the wearer 12 and the body odor absorbing material 70. It should be understood that any mechanism for retaining a body odor absorbing material 70 in a pocket 32 may be used to practice the invention with the illustrated embodiment only be representative of mechanisms which may be used. Moreover, it is not essential that the pocket 32 be defined by an open weave or mesh permitting substantial contact of the bare skin 38 of the wearer with the body odor absorbing material 70. It should be understood that the construction of the pockets 32, as illustrated in FIGS. 1–6, may be in accordance with FIG. 7. The practice of the invention is enhanced by the placement of pockets 32 on the inside surface of the garment 10 anywhere where the bare skin 38 of the wearer will provide for the substantial absorbance of odor within the body odor absorbing material 70 with the most likely areas being in proximity to the breasts, axillae and groin.

Figure 8:
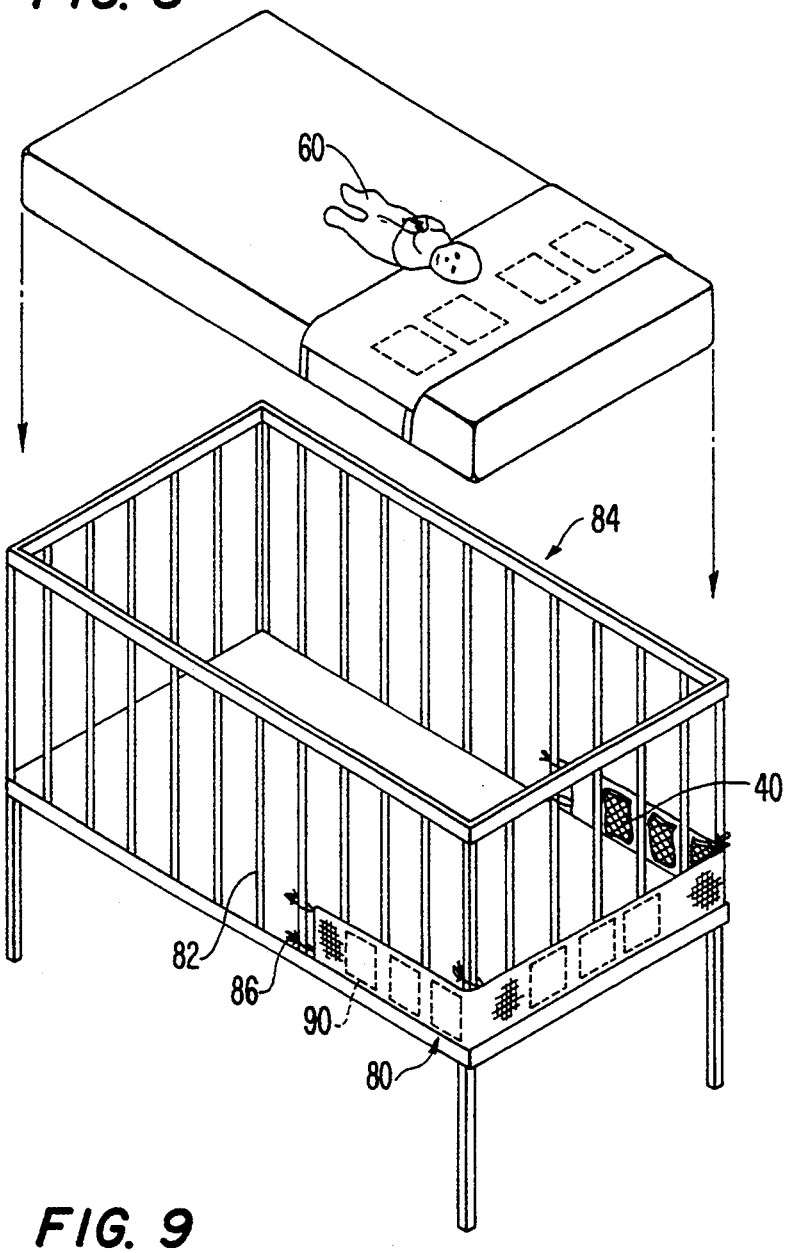
FIG. 8 illustrates a mechanism for attaching body odor absorbing material(s) which have been in contact with the persons' skin during wearing of the garment of FIGS. 1, 2, 5 and 6 on a garment support in the form of the slats of a crib and a mattress such as illustrated in FIGS. 3 and 4 positioned therein.
Figure 9:
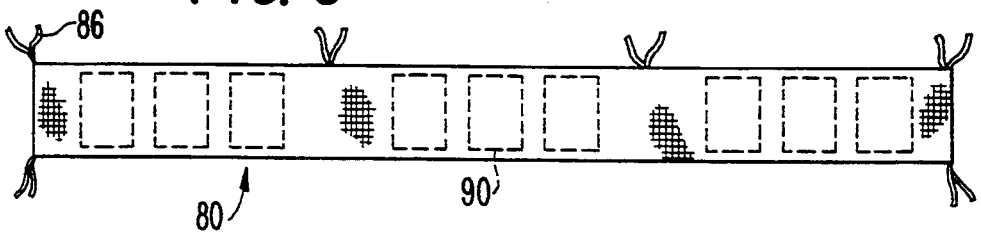
FIGS. 9 and 10 illustrate details of the garment support illustrated in FIG. 8.
Figure 10:
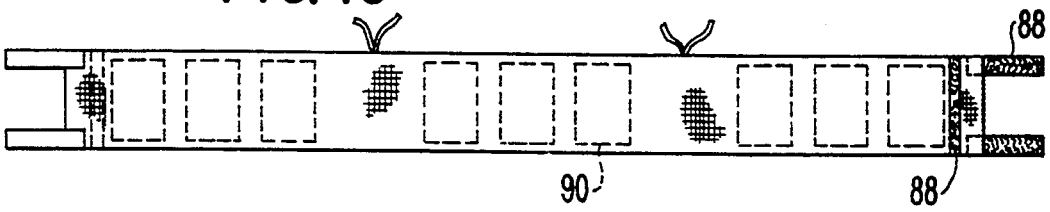

FIGS. 8–10 illustrate an alternative embodiment of the invention where the body odor absorbing material 70 after wearing in the garment as previously described is placed in a carrier 80 which is attached to the vertical slats 82 of a crib 84. A series of attachment mechanisms 86, which may be in the form of ties and/or hook and loop pile fasteners (VELCRO) attachments attach the carrier 80 to the crib 84. As illustrated, a series of pockets 90 are attached to the carrier 80, like those described above in conjunction with FIGS. 1–6 including openings 40, for retaining the body odor absorbing materials 70 which have been impregnated with retained odor from the wearer of the garment 10 as described above.

Furthermore, the mattress 50 of FIGS. 3 and 4 may be placed inside of the crib 84 as illustrated in exploded form. The body odor absorbing material 70 which was retained in the pockets 32 during wearing of the garment left in the pockets 32 and/or is placed within the pockets 90. In this situation, the infant's nose is in close proximity to the garment 10, including any body odor absorbing materials retained in pockets 32, and further is also in proximity to the body odor absorbing materials which have been inserted into the pockets 90. If the infant 60 is made uncomfortable as a result of the thickness of the body odor absorbing materials 70 within the pockets 32, only the pockets 90 need be used to retain the body odor absorbing materials. However, it should be understood that the body odor absorbing material 70 may be left within the pockets 32 of the garment and further the pockets 90 may also contain additional body odor absorbing material 70 which materials have absorbed odor by several days of wearing of the garment 10.

Figure 11:
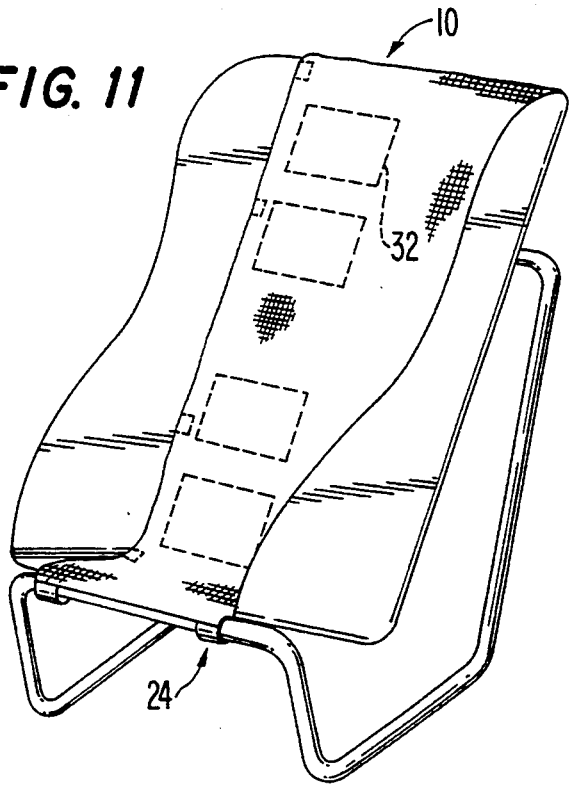
FIG. 11 illustrates an infant car seat used as a garment support for the garment of FIGS. 1 and 2.
Figure 12:
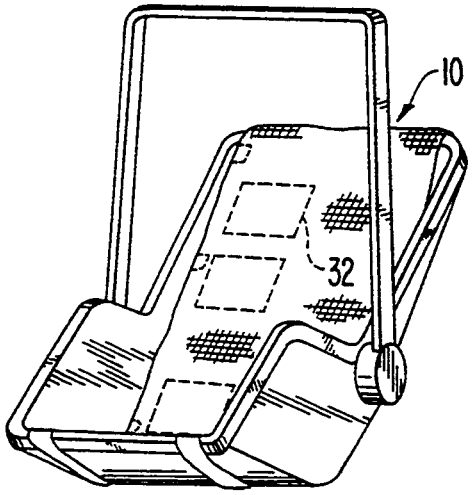
FIG. 12 illustrates an infant carrier used as a garment support for the garment of FIGS. 1 and 2.
Figure 13:
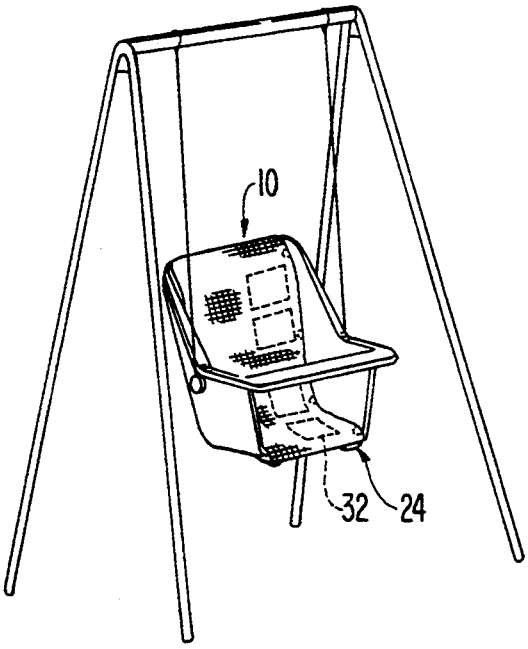
FIG. 13 illustrates an infant swing used as a garment support for the garment of FIGS. 1 and 2.

FIGS. 11, 12 and 13 respectively illustrate alternative garment supports for the garment 10 of FIGS. 1–4. FIG. 11 illustrates the garment support in the form of an infant car seat; FIG. 12 illustrates the garment support in the form of an infant carrier; and FIG. 13 illustrates the garment support in the form of an infant swing. In each of the alternative embodiments of FIGS. 11–13, the fastening mechanism 24 performs the dual function of attaching the garment to the wearer and to the garment support as described above in conjunction with FIGS. 1–4.

While the invention has been described in terms of its preferred embodiments, it should be understood that numerous modifications may be made thereto without departing from the spirit and scope of the invention. Accordingly, it is intended that all such modifications fall within the scope of the appended claims.

I claim:

1. A process for promoting bonding between a person and an infant or young child comprising:

wearing a garment in contact with at least the person's torso and the person's axillae with the garment comprising a material which absorbs odor from the torso and the auxillae, a pair of pockets disposed on an inside surface of the garment for containing a removable odor absorbing material which absorbs odor to a greater degree than a remainder of the garment with the pockets being positioned to be worn in contact with either the person's breasts or auxillae and a fastening means for attaching the garment to the torso and the auxillae for a time sufficient to retain the odor;

attaching the worn garment to a garment support with the fastening means, the said worn garment now being sufficiently close to the infant or young child so that the infant or young child smells the retained odor for a time sufficient to promote bonding; and periodically refreshing said material over a period of time by the person repeatedly wearing the garment to refresh the odor followed by attaching the garment to the garment support a plurality of times during a period of time while bonding is occurring.

2. A process in accordance with claim 1 wherein: the garment support is a mattress.

3. A process in accordance with claim 1 wherein: the garment support is a car seat.

4. A process in accordance with claim 1 wherein: the garment support is an infant swing.

5. A process in accordance with claim 1 wherein: the garment support is an infant carrier.

6. A process in accordance with claim 1 wherein: the garment includes an elongated side and further comprises removable straps with the straps each being attached at two spaced apart positions along an elongated side with arms of the person extending through loops defined by the straps and the elongated side during wearing of the garment.

7. A process in accordance with claim 1 wherein: the fastening means comprises at least one hook and loop pile fastener attached at opposed ends of the garment with the fastener attaching the garment to the torso during absorbing of the person's odor and to the garment support during bonding of the infant or young child to the person's odor.

8. A process in accordance with claim 1 wherein:

the fastening means comprises at least one tie attached at opposed ends of the garment with the tie attaching the garment to the torso during absorbing of the person's odor and to the garment support during bonding of the infant or young child to the person's odor.

* * * * *